United States Patent [19]

Barber

[11] Patent Number: 4,903,959

[45] Date of Patent: Feb. 27, 1990

[54] HORIZONTAL FERRIS WHEEL

[76] Inventor: Gerald L. Barber, 10 Whittington Ct., Greenville, S.C. 29615

[21] Appl. No.: 254,439

[22] Filed: Oct. 5, 1988

[51] Int. Cl.[4] ..... A63G 1/08; A63G 1/28

[52] U.S. Cl. ..... 272/29; 272/40; 272/41

[58] Field of Search ..... 272/29, 28 R, 33 R, 272/34, 41, 40, 39, 44

[56] References Cited

U.S. PATENT DOCUMENTS

| | | | |
|---|---|---|---|
| 1,107,287 | 8/1914 | Gibson . | |
| 1,262,687 | 4/1918 | Miller . | |
| 1,337,820 | 4/1920 | Butcher . | |
| 1,693,724 | 12/1928 | Morris | 272/40 |
| 2,162,877 | 6/1939 | Bisch | 272/41 |
| 2,399,332 | 4/1946 | D'Errico | 272/44 |
| 2,659,601 | 11/1953 | Siverts | 272/36 |
| 2,765,168 | 10/1956 | Taylor | 272/41 |
| 2,950,109 | 8/1960 | Forbush | 272/41 |
| 3,155,389 | 11/1964 | Winton | 272/33 |
| 3,176,983 | 4/1965 | Barber | 272/29 |
| 3,235,251 | 2/1966 | De Shano | 272/33 R |
| 3,455,549 | 7/1969 | Forbush | 272/41 |
| 3,484,104 | 12/1969 | Goforth et al. | 272/29 |
| 3,552,747 | 1/1971 | Deem | 272/29 |
| 3,596,905 | 8/1971 | Brown | 272/29 |
| 3,666,264 | 5/1972 | Bartlett | 272/29 |
| 3,840,225 | 10/1974 | Fouche | 272/29 |
| 4,513,960 | 4/1985 | Barber et al. | 272/44 |

*Primary Examiner*—Richard E. Chilcot, Jr.
*Attorney, Agent, or Firm*—Dority & Manning

[57] ABSTRACT

An amusement ride comprises a horizontal ferris wheel, having an upright shaft with a circular member rotatably mounted near the top thereof. Passenger compartments, such as gondolas, are suspended from the circular member. One or more rotatable propellers also supported on the circular member drive the circular member about the upright shaft, instead of using driven rotation of the central shaft itself through various gear or drive belt arrangements. As compared with gears and drive belts, the propeller-driven arrangement provides relatively smooth acceleration and deceleration. A flyball governor mechanism closes louvers over the propeller to control air flow therefrom, and slow rotation of the amusement ride whenever predetermined rotational speeds are reached. Relatively smaller embodiments of the invention are adapted for rapid and convenient alternate assembly and disassembly, and for transport on a trailered base thereof, for use at a desired location such as fair grounds or the like.

21 Claims, 6 Drawing Sheets

HORIZONTAL FERRIS WHEEL

BACKGROUND OF THE INVENTION

This invention generally concerns an amusement ride, and more particularly concerns a ride which carries a rider about a circular path driven by a rotating propeller or the like. In one preferred embodiment, the ride is also portable and easily alternately assembled and collapsed.

Heretofore, numerous amusement rides have been provided for carrying an occupant, particularly in a circular path. Some of such rides have been driven by gears or belts which turn a central member. For example, U.S. Pat. No. 3,176,983 (Barber) discloses a meshing of driven gears to turn a portable ride. U.S. Pat. No. 4,513,960 (Barber et al.) discloses a chain and associated gear driven by a stationary motor to in turn rotate a central hub.

U.S. Pat. Nos. 1,337,820 (Butcher) and 1,107,287 (Gibson) concern rides simulating or otherwise suggesting the sensations associated with flight in an airplane. Butcher includes rotatable propellers to contribute to the psychological effect of his simulation, but orbital movement of the airplanes about the ride is powered from a centralized drive shaft. Gibson illustrates no propeller feature, and uses a drive motor 15 and meshing gears to rotate his simulated airplanes.

Many other drive arrangements for rotating amusement rides are known. Some examples of such arrangements generally include: U.S. Pat. No. 1,262,687 issued to Miller; U.S. Pat. No. 2,399,332 issued to D'Errico; U.S. Pat. No. 2,659,601 issued to Siverts; U.S. Pat. No. 2,765,168 issued to Taylor; U.S. Pat. No. 3,155,389 issued to Winton; U.S. Pat. No. 3,235,251 issued to De Shano; U.S. Pat. No. 3,484,104 issued to Goforth et al.; U.S. Pat. No. 3,552,747 issued to Deem; U.S. Pat. No. 3,596,905 issued to Brown; U.S. Pat. No. 3,666,264 issued to Bartlett; and U.S. Pat. No. 3,840,225 issued to Fouche.

A number of such prior drive arrangements (e.g., meshing gears, drive belts, chains, etc.) contain a number of complicated and/or interacting parts which may require frequent maintenance, such as lubrication, repair or other servicing. They may also tend to commence rotation of the ride rather abruptly (such as due to engagement of a clutch or the like), which is generally undesirable and in some instances potentially dangerous. Stopping may entail an equal lack of smoothness, particularly when considering the entire period of deceleration rather than just the actual moment of stopping.

Particularly concerning portable rides, such rides have often required an excessive amount of time for assembly and disassembly because numerous parts had to be entirely disconnected and reconnected in order to move the ride to a new location. Such relatively complicated arrangements obviously require time for their relocation and can constitute a safety hazard if hurriedly set-up improperly.

SUMMARY OF THE INVENTION

The present invention recognizes and addresses such drawbacks and others of amusement rides generally and, portable and collapsible amusement rides in particular. Accordingly, one important object of the present invention is to provide an improved amusement ride. A more particular present object is to provide a simplified drive arrangement for rotating an amusement ride.

Another general object of the present invention is to provide an amusement ride which can be quickly assembled and disassembled (i.e., collapsed), without need to completely disconnect all of its component parts.

Yet another object of the present invention is to provide an alternative embodiment of an amusement ride which incorporates a trailer on which its components may be conveniently stored during transportation of the ride to a new site.

Still another more specific object of the present invention is to provide an improved amusement ride with such simplified drive arrangement, yet which commences rotation from a standstill very smoothly and without any abrupt jerk, and which likewise smoothly stops.

Yet another object of the present invention is to provide an amusement ride including a safety device which automatically acts to slow the rotation of the ride if a predetermined speed of rotation is reached.

Another general object is to provide a horizontal ferris wheel-type amusement ride, of considerably variable selected diameter, driven by a rotating propeller or its equivalent.

These and other objects, aspects and features of this invention are more particularly discussed and described in the remainder of the specification. Various modifications and alterations to the features, elements and constructions disclosed herewith may occur to those of ordinary skill in the art, and are intended to come within the spirit and scope of this invention by virtue of present reference thereto. Such modifications and variations may include, but are not limited to, the substitution of functionally equivalent structures and elements for those expressly disclosed, illustrated or suggested herewith, as well as the interchange of various features and elements (e.g. reversal of parts) previously disclosed.

Furthermore, different embodiments of the present invention may comprise various combinations of presently disclosed features. One exemplary such amusement ride in accordance with the present invention comprises a central, upright support mast; support structure, rotatably mounted on the top of the support mast, and projecting axially outward from such mast for free rotation thereabout generally in a plane perpendicular to the longitudinal axis of the mast; passenger compartments suspended from the support structure generally near the periphery thereof; and at least one rotatably drivable propeller supported on such structure, such that rotation of the propeller generates a flow of air creating a driving force acting generally tangentially at the support structure periphery. With the foregoing, passenger compartments may be rotated about the central mast for forming a horizontal ferris wheel-type amusement ride having relatively smooth acceleration and deceleration characteristics.

Another exemplary construction concerns a horizontal ferris wheel, comprising a relatively flat horizontal support surface and means for supporting a fixed vertical shaft thereon; a vertical shaft supported on and extending upwardly from the support surface; a hub assembly rotatably attached to the upper end of the vertical shaft; an upper support portion of the ferris wheel situated generally about the hub assembly; means for connecting the hub assembly to the upper support portion of the ferris wheel, with such upper support portion being rotatable about the vertical shaft on the hub assembly; a plurality of passenger-carrying gondolas supported on the ferris wheel upper support portion; a first support beam extending generally from the vertical shaft in a direction parallel to that of the ferris wheel upper support portion, such support beam having attached thereto a rotatable propeller; and means for rotating such propeller, whereby the force generated by a flow of air from the rotating propeller will cause the ferris wheel upper support portion and the gondolas supported thereon to rotate about the vertical shaft.

A further amusement ride embodiment in accordance with this invention is directed to a collapsible horizontal ferris wheel, comprising a movable platform defining a relatively flat horizontal upper support surface; a fixed vertical shaft supported on, and extending upwardly from, such upper support surface, such shaft having a free upper end; a hub assembly attached to the vertical shaft upper end, and including studs extending upwardly therefrom; a cylindrical housing, having respective upper and lower ends, and rotatably mounted about the vertical shaft on the hub assembly, and further defining an inner bore having therein an insert plate adapted to matingly engage the studs; circular gondola support means, situated about the vertical shaft; a plurality of first cables attached to the cylindrical housing upper end spaced about the circumference thereof, and respectively extending to the gondola support means; and a plurality of second cables attached to the cylindrical housing lower end spaced about the circumference thereof, and respectively extending to the circular gondola support means, such that the first and second plurality of cables cooperate to suspend the circular support means on the vertical shaft at a generally predetermined elevation above the movable platform upper support surface.

The foregoing embodiment preferably further includes a plurality of gondolas, suspended from the circular gondola support means and spaced thereabout, such gondolas being adapted for carrying passengers; at least one support beam, having an outer end extending outwardly from the cylindrical housing in a direction generally parallel to the movable platform upper support surface; fan means attached to the support beam outer end, such fan means including a rotatable propeller and a protective shroud generally thereabout; and power means for supplying power to the fan means propeller for rotation thereof, whereby the force generated by such fan means propeller rotation causes the cylindrical housing, the gondola support means, and the plurality of gondolas supported thereon, to rotate about the vertical shaft.

Such foregoing collapsible embodiment may be collapsed for portability thereof such as by disassembling the circular gondola support means into sections so as to relieve tension in the first and second plurality of cables, by folding the support beam downwardly towards the vertical shaft, and by stacking the gondolas on the movable platform support surface.

Additional aspects and features of such exemplary embodiments and others are discussed in greater detail below.

BRIEF DESCRIPTION OF THE DRAWINGS

A full and enabling disclosure of the present invention, including the best mode thereof, to one of ordinary skill in the art is set forth more particularly in the remainder of this specification, including reference to the accompanying figures, in which.

Figure 1:
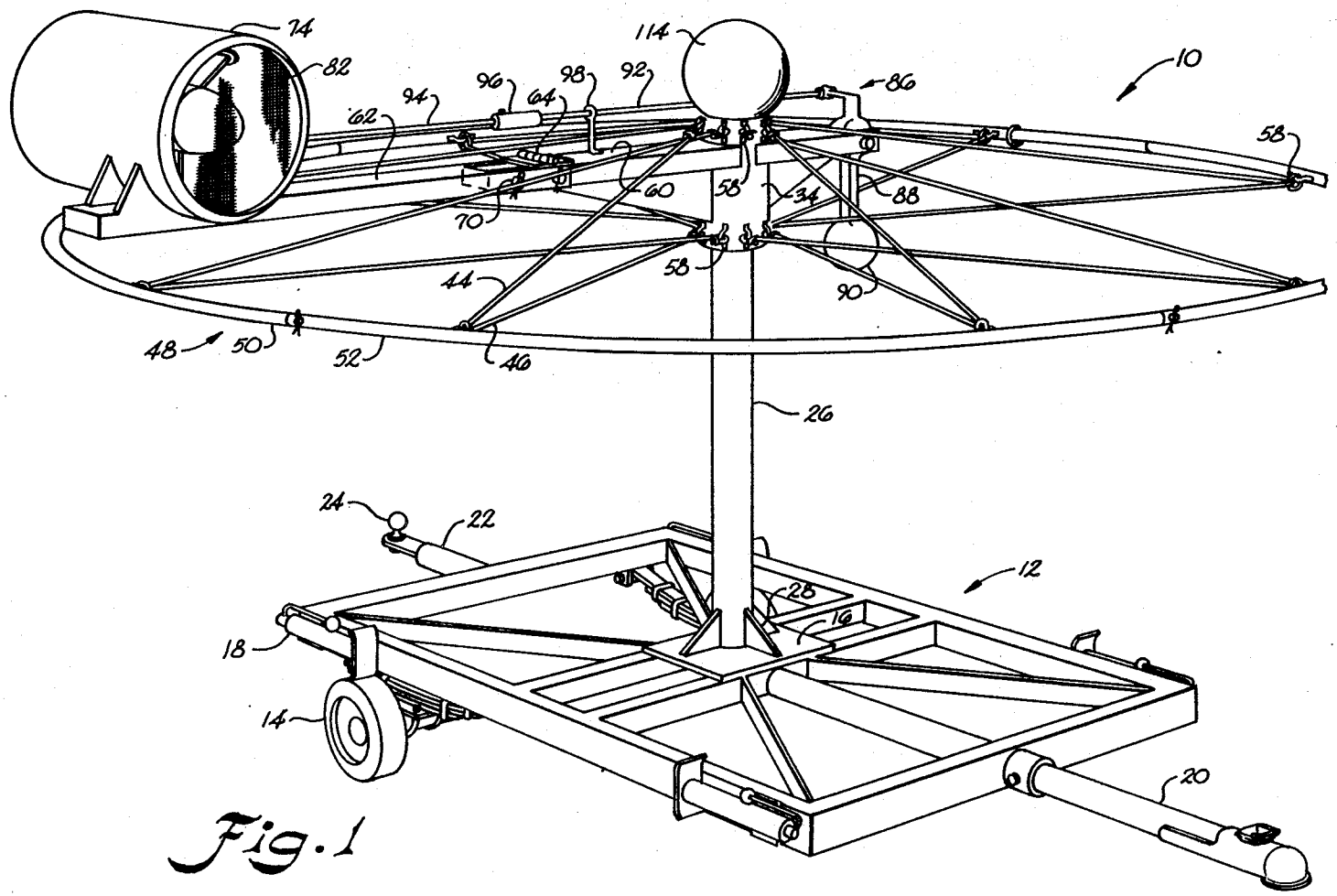
FIG. 1 illustrates a perspective view of an exemplary embodiment of the present invention partially disassembled (i.e., without passenger gondolas)

Repeat use of reference characters in the following specification and appended drawings is intended to represent the same or analogous features or elements of the present invention.

DETAILED DESCRIPTION OF THE PREFERRED EMBODIMENTS

Those of ordinary skill in the art will appreciate that this invention is generally directed to an amusement ride, and more particularly a horizontal ferris wheel-type ride which carries a rider in a circular path. Furthermore, the invention (as to certain embodiments) can be readily disassembled and reconfigured for portability.

Notwithstanding such exemplary general features, those of ordinary skill will further appreciate that the following disclosure is for purposes of example only, and is not intended to limit broader aspects of the invention embodied thereby.

Figure 2:
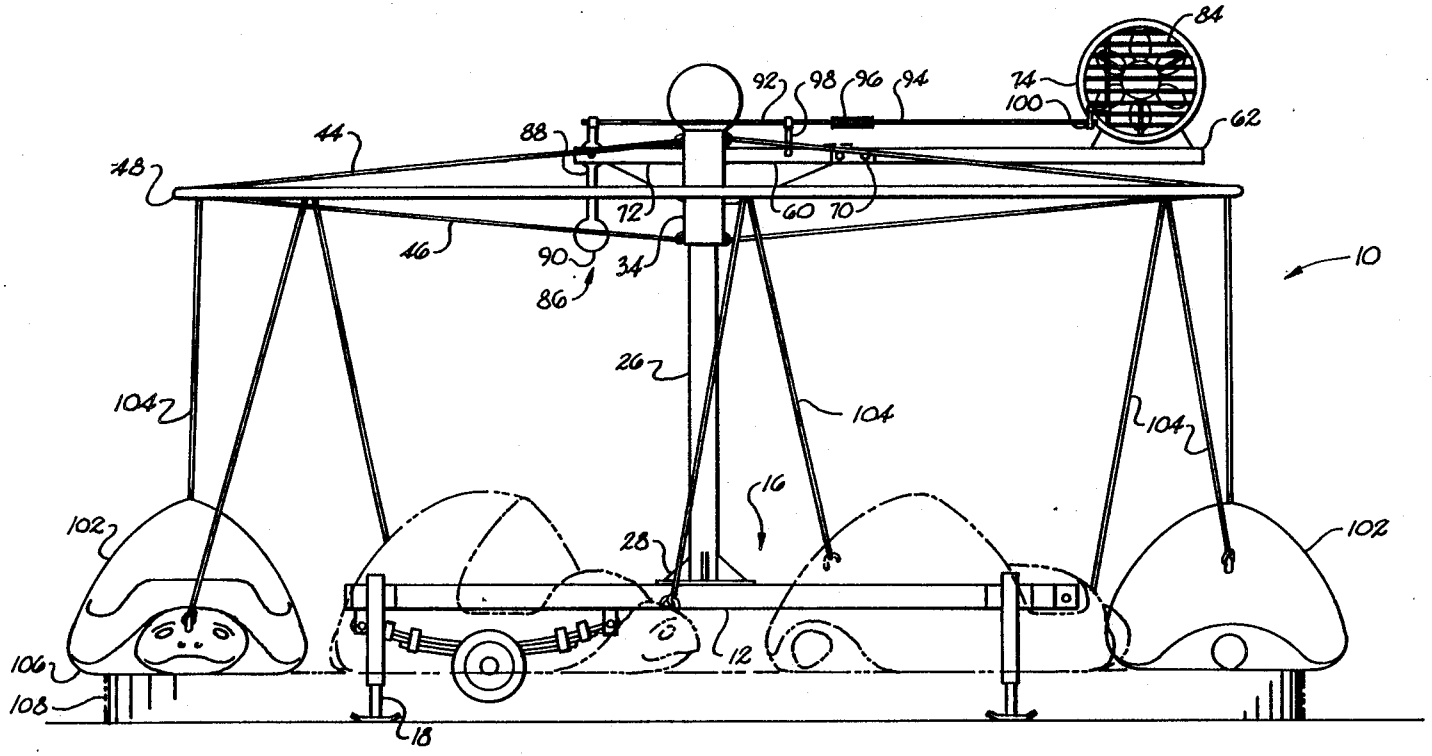
FIG. 2 illustrates a side view of an exemplary embodiment of the present invention similar to that of present FIG. 1 configured for operation (including passenger gondolas)
Figure 7:
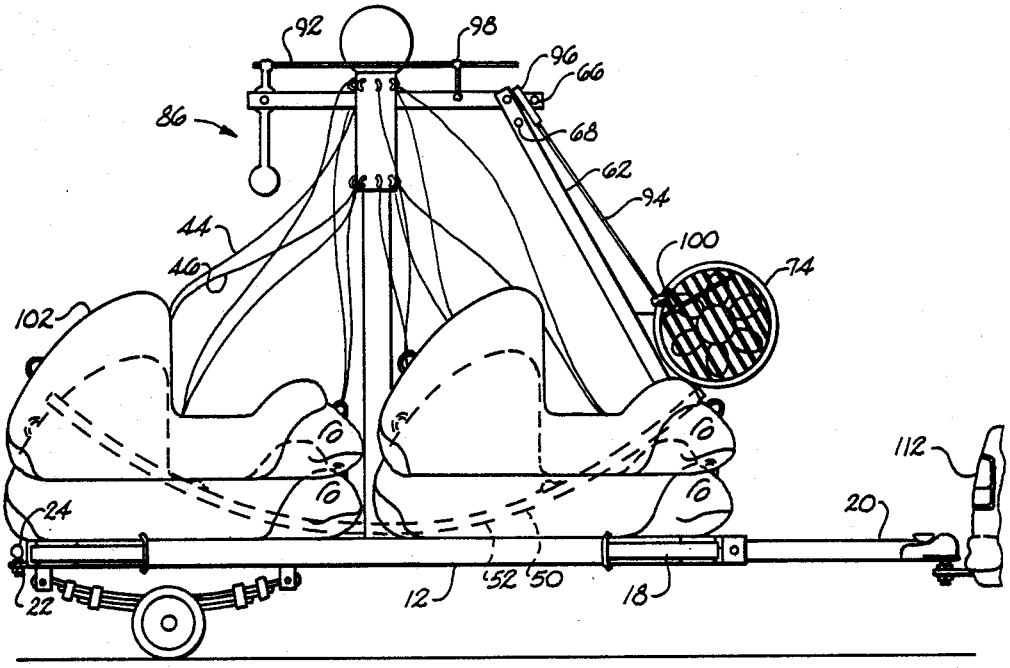
FIG. 7 illustrates a side view of an exemplary embodiment of the present invention as configured (i.e., collapsed) for towing behind a vehicle or another trailer.

Referring now in greater detail to the drawings, FIGS. 1 and 2 illustrate an amusement ride preferably constituting a horizontal ferris wheel 10, supported in this instance by a movable platform, such as a wheeled trailer 12 or the like including a generally horizontal upper support surface 16. Trailer 12 may comprise numerous alternative constructions, but preferably further includes a plurality of adjustable support legs 18 for positioning and balancing ferris wheel 10 during use (e.g., as in FIG. 2), and for being retracted whenever trailer 12 is towed (e.g., as in FIG. 1). A first retractable tongue 20 for towing vehicle 112, (such as with vehicle 112; FIG. 7) is provided on trailer 12. A second tongue 22 including a towing ball 24 may be provided on an opposite side of trailer 12 from first tongue 20 thereof, to permit towing in series of more than one trailer at a time.

Figure 3:
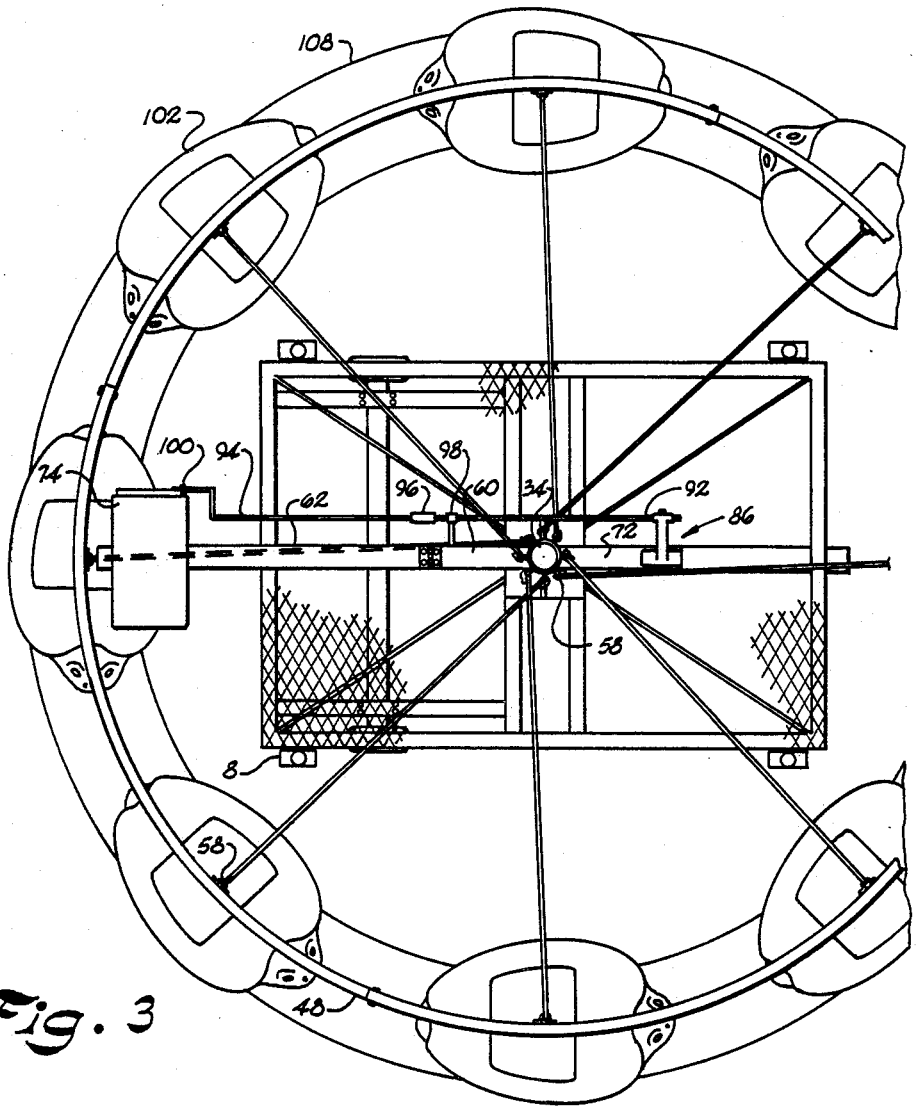
FIG. 3 illustrates a partial top view of a present exemplary embodiment of the invention, similar to that of FIG. 2, and also configured for operation.
Figure 4:
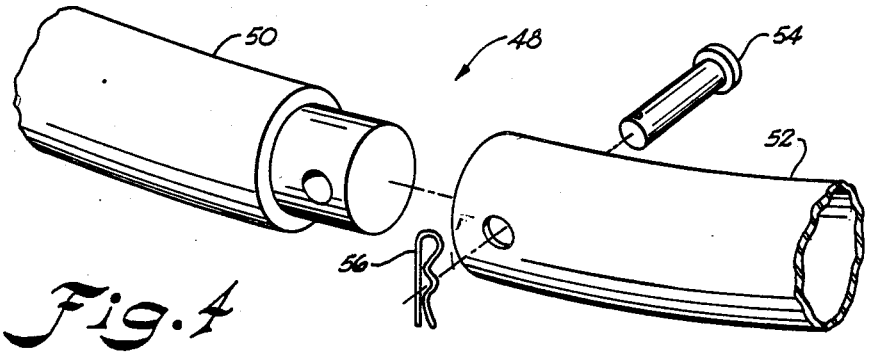
FIG. 4 illustrates an enlarged, partial perspective view of an exemplary embodiment of the coupling between circular gondola support means sections of the present invention.
Figure 5:
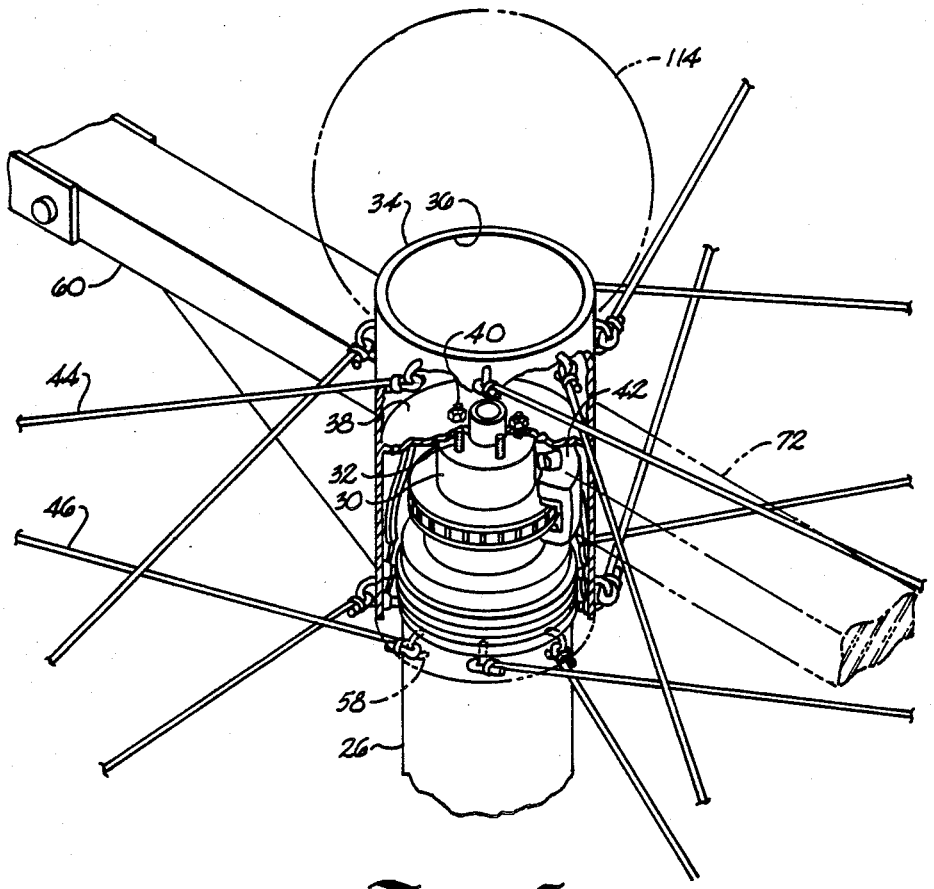
FIG. 5 illustrates a perspective view of an upper end of an exemplary vertical shaft feature of the present invention, with cylindrical housing features thereof illustrated in partial cut-away and see-through for revealing other features internal thereto.

Vertical shaft 26 is supported on and secured to horizontal surface 16, and preferably reinforced by various members such as shaft braces 28. As also shown by FIGS. 3 through 5, a hub assembly 30 is rotatably attached to the upper end of vertical shaft 26. As is conventional, the hub assembly may include a plurality of upwardly extending studs 32, and be disposed inside of an inner bore 36 of a cylindrical housing 34. An insert plate 38 is formed integral with cylindrical housing 34 and defines holes 40 for engaging conventional studs 32. With such an arrangement, cylindrical housing 34 is free to rotate about fixed vertical shaft 26 on hub assembly 30.

Electrically-actuated solenoid brake shoes 42 may be optionally included about hub assembly 30, and are fixed relative to fixed vertical shaft 26. Thus, brake shoes 42 may be used to slow the rotation of hub assembly 30 about fixed shaft 26, and thereby slow the rotation of ferris wheel 10, when desired. An optional decorative glass or mirrored ball 114 or the like may be mounted on top of vertical shaft 26, if desired.

A circular ring structure 48 comprising circular gondola support means is supported about vertical shaft 26 at a predetermined elevation above surface 16 of trailer 12 by a plurality of first cables 44 (under tension) and a plurality of second cables 46 (also under tension), which extend outwardly from cylindrical housing 34 to ring 48. The cables, which may comprise steel (although not limited to such), are secured to cylindrical housing 34 and the ring 48 by tensioned cable connectors 58. Integral with the housing and ring, cables 44 and 46 are secured near top and lower portions, respectively, of housing 34 (see, for example, FIGS. 1 and 5). Also, the cables are preferably oriented in an overlapping, crisscrossing manner similar to spokes on a bicycle wheel (as shown in FIG. 3), such that ring 48 is held fixed relative to cylindrical housing 34.

Ring 48 preferably comprises, but is not limited to, steel pipe. It also is preferably formed in at least two sections 50 and 52 (see FIG. 4) and possibly more, which are matingly engageable and secured by a conventional locking pin 54 and clip 56, or the like. Pin 54 is inserted through ring sections 50 and 52 at their point of connection, and clip 56 is then inserted through pin 54 to keep the pin seated within the ring sections. The purpose of the disconnectable sections is to permit partial disassembly (i.e., collapse) of the ferris wheel to facilitate transport thereof.

A first (at least one) support beam 60 extends outwardly from cylindrical housing 34 (see, for example, FIGS. 2 and 3), and includes hinged end portion 62. To fix hinged end portion 62 horizontally, a beam locking rod 70 is placed through concentric holes 66 and 68 in beam 60 and hinged end portion 62, respectively.

Figure 6:
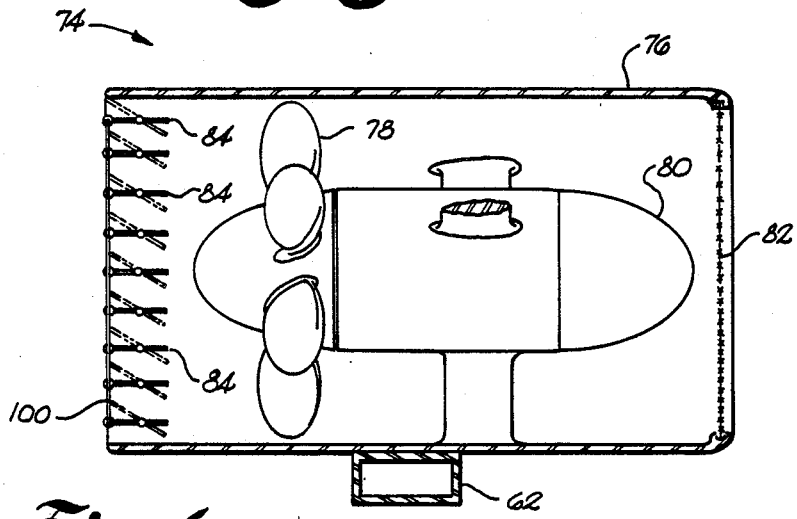
FIG. 6 illustrates a generally side crosssectional view of an exemplary fan means embodiment of the present invention.

Fan means 74 is preferably disposed at the outer (i.e., extended) edge of hinged end portion 62, for maximizing a torque arm effect with beam 60 relative vertical shaft 26. Fan means 74 may include a variety of constructions. In the exemplary embodiment, as shown in FIG. 6, it defines a generally stationary shroud 76, a rotatable propeller 78, and propeller power source 80. Mounted inside shroud 76 are a screen 82 to protect propeller 78 from debris, and a plurality of rotatable louvers 84 which, during normal rotation of ferris wheel 10, permit a flow of air through fan means 74, to actuate rotation of the horizontal ferris wheel 10 about vertical shaft 26 by blowing air in a lateral direction tangential to ring 48.

The respective louvers 84 may be variously selectively positioned to block such driving air flow through fan means 74 if the ferris wheel spins too quickly. An exemplary mechanism for controlling the louver positions is disclosed and described herewith. A second support beam 72 extends outwardly from housing 34, generally opposite from first beam 60, as shown in FIGS. 2 and 3. Pivotally attached to second support beam 72 is a fly-ball governor means 86 comprising a bar 88 and a weight 90. Weight 90 is disposed at one end of bar 88, which is pivotally mounted on beam 72. Thus, Weight 90 hangs below beam 72 similar to a pendulum. The other end of bar 88 is pivotally attached to a first push rod 92. A push rod pivoting arm 98 integral with beam 72 supports first push rod 92. A collar 96 is attached between rods 92 and 94. An end of rod 94 which is not attached to push rod collar 96 is attached to louver activating means 100. First and second push rods 92 and 94 thus essentially form one linear member connected by a push rod collar 96, such one linear member extending between pivoting bar 88 (which directly supports weight 90) and louver activating means 100.

During normal rotation of ferris wheel 10, there is relatively little centrifugal force acting on flyball governor means 86; therefore, weight 90 is displaced very little from its vertical position shown in FIGS. 2 and 7. Generally, an operator will manually control the rotation speed of the horizontal ferris wheel 10 by controlling operation of propeller power source 80. However, in case of much more rapid rotation of amusement ride, the correspondingly increased centrifugal force pushes weight 90 outwardly from vertical shaft 26, in turn causing first and second push rods 92 and 94 to pivot about push rod pivoting arm 98, and to activate louver actuating means 100, which at least partially blocks or limits air flow through fan means 74. Details of the louver activating means 100 are commonly known, and thus not be described here in detail.

Flyball governor means 86 serves as a safety device, since resulting actuation of louvers 94 as described above limits air flow through fan means 74, thereby slowing the ride from excessive rotation speeds. The speed at which flyball governor means 86 is activated depends on the relative sizes and masses of bar 88 and weight 90, and the pivotal motion of first and second push rods 92 and 94 about push rod pivoting arm 98, and the like. Thus, various "safe" speeds and limits may be selected, as desired, by those of ordinary skill in the art through appropriate selection of the component weights, etc.

Electronic switching means such as a reversible drum switch (not shown, but commonly known), may be included to control propeller power source 80 and/or solenoid brakes 42. The rotation of propeller 78 may be reversed during "forward" rotation of the amusement ride, to provide further braking effort. Of course, ceasing rotation of propeller 78 also "brakes" the amusement ride, since it would thereafter coast to a stop. Electric power to motor 80 (when comprising an electric motor) may be supplied through slip rings, brushes, or the like, as well known to those of ordinary skill in the art for powering a rotatable electric load. Of course, motor 80 may alternatively comprise a gasoline-powered engine or the like, with remote gas control. Likewise, the flyball governor means or equivalent safety features may be used to directly govern the speed or motor 80 or operate brakes 42, rather than control the driving air flow force from propeller 78.

Figure 8:
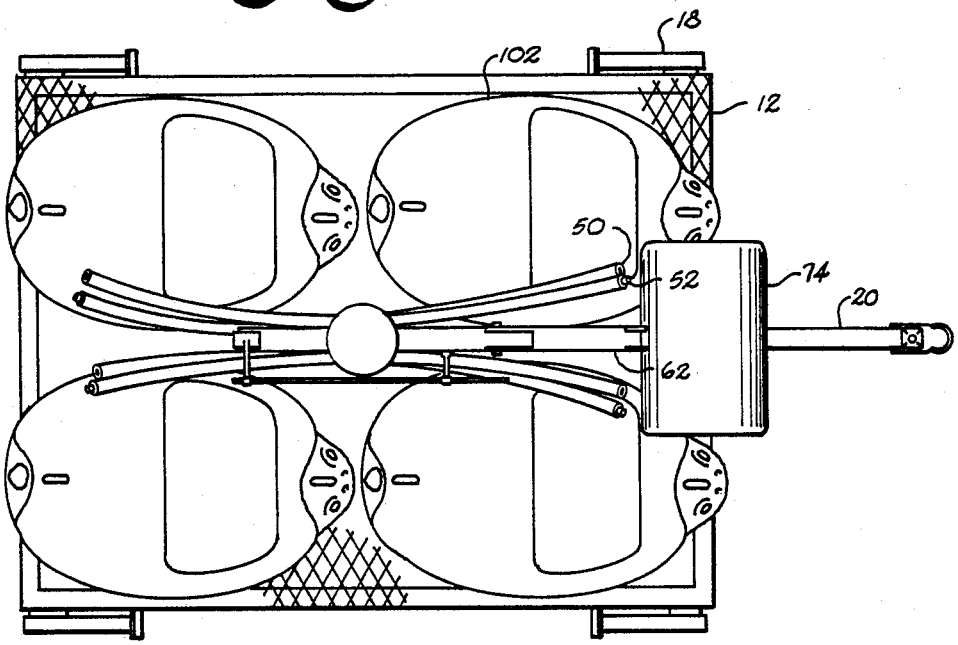
FIG. 8 illustrates a top view of an exemplary embodiment of the present invention such as that of FIG. 7, also collapsed and configured for towing behind a vehicle or another trailer.

A plurality of gondolas 102 are suspended from ring 48 (i.e., gondola support means) by cables 104 as shown, for example in FIG. 2. Gondolas 102 may be made of fiberglass and/or thermoformed plastic or any other suitable material. Likewise, they may assume fanciful shapes and colors, as desired. When disassembled from the ride (i.e., removed from cables 104), gondolas 102 are conveniently stackable one on top of another to preserve space aboard the trailer during transport of the horizontal ferris wheel 10, as represented in FIGS. 7 and 8. Gondolas 102 may also include a bottom surface 106 adapted for rolling or sliding contact with an optional track 108 on which the gondolas could be guided about whenever the ride is configured with ring 48 place relatively close to the ground.

To assemble the ride after towing same to a desired location (i.e., render the ride operable rather than collapsed), trailer 12 is first disconnected from any vehicle or other trailer, and all towing tongues 20 or 22 are retracted. Hinged end portion 62 of first support beam 60 is raised and locked into place by inserting beam locking rod 70 into locking rod holes 66 and 68. The first and second push rods 92 and 94 are attached to push rod collar 96. The ring sections 50 and 52 (or greater number of sections, if provided) are connected together with corresponding locking pins 54 and locking pin clips 56 to form the ring 48. Since cables 44 and 46 are preferably not disconnected from the housing 34 or ring 48, such assembly of ring 48 will also result in the application of tension to such cables, thereby supporting ring 48 above the ground by a predetermined distance.

Thereafter, trailer 12 is raised by rotating support legs 18 thereof so as to bring them into contact with the ground, which in turn lifts trailer wheels 14 off the ground to provide stable support for the ride. Gondolas 102 may then be hung from ring 48 on support cables 104. If a circular track 108 is to be used, it can be placed beneath the gondolas 102.

To disassemble or collapse the ride, steps reverse to those described above should be taken.

All disassembled parts of the horizontal ferris wheel 10 are storable on trailer 12, for portability as depicted in FIGS. 7 and 8. Once disassembled, gondolas 102 may be conveniently stacked or nested, and carried directly on the wheeled trailer. FIGS. 7 and 8 show four stacks comprising two gondolas 102 each, although it is to be understood that any convenient arrangement of the gondolas on the trailer is possible.

When separated into sections 50 and 52 (or more), ring 48 may be carried adjacent to gondolas 102 on the trailer. As mentioned above, the first and second plurality of cables 44 and 46 need not be separated from cylindrical housing 34 or ring sections 50 and 52 for disassembly or for transportation of the horizontal ferris wheel 10. Such continuous cable connections as otherwise incorporated into the present structure saves considerable time in assembly and disassembly of the ride. Having continuous connections for the passenger support features also contributes to inherent safety of the ride, since passenger support will not as directly depend on each assembly of the ride. Hinged end portion 62 of beam 60 may rest on either gondolas 102 or the front of trailer 12. After removal of locking rod 70, legs 18 are rotated back to the position thereof shown in FIG. 7, allowing wheels 14 to again contact the ground. FIG. 7 represents trailer 12 as connected to a vehicle 112 by first retractable tongue 20, although it is to be understood that it may also be connected by second retractable tongue 22 to another such trailer 12, to be pulled in tandem behind vehicle 112.

Use of fan means 74 is a relatively uncomplicated solution to the drive needs of ride 10, yet it provides for a relatively smoother and more gradual start up of horizontal ferris wheel 10 than normally would other typical drive means, such as belts or gears driven directly or through a clutch-operated transmission by a motor. The smooth commencement of rotation adds to the safety, as well as to the enjoyment, of the ride. Likewise, the present ride configuration and drive arrangement permits an equally undisconcerting (i.e., smooth and gradual) slowing and stopping of the ride. Such smooth acceleration and deceleration of the ride (as compared with more jerky operation) can even contribute to the willingness of some riders (such as younger children, especially) to be a passenger.

As another safety feature, as discussed above, louvers 84 insure that ferris wheel 10 does not rotate at a dangerous speed. The louvers are automatically positioned to substantially block air flow through the fan means at high rotation speeds through operation of flyball governor means 86, should an operator fail to properly control speed of the ride. Centrifugal force drives weight 90 outwardly from vertical shaft 26, thereby causing the first and second push rods 92 and 94 to activate louver actuating means 100 for slowing the horizontal ferris wheel 10.

Figure 9:
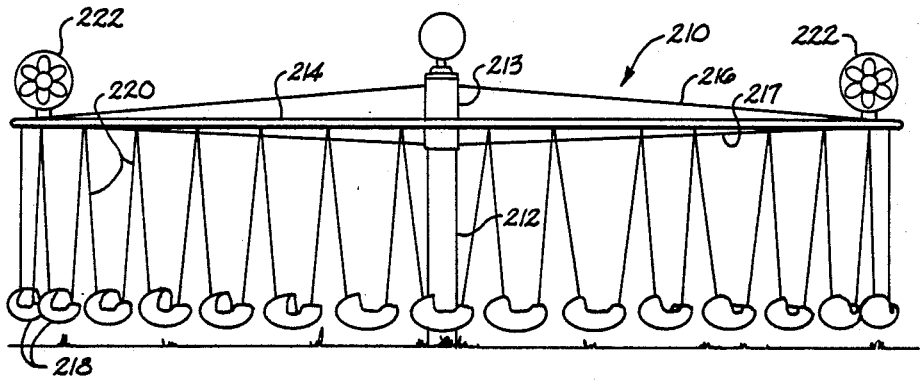
FIG. 9 illustrates a side view of another, relatively larger exemplary embodiment of the present invention, more specifically adapted for permanent (i.e. non-portable) securement at a particular location.

FIG. 9 illustrates a second exemplary embodiment 210 of the present invention. This particular embodiment is not supported on a trailer, and may therefore be of virtually any size construction desired. A vertical shaft 212 secured to the ground (or an equivalent stable platform) supports a rotatable upper portion 213. Ring 214 is supported by tensioned cables 216 and 217 secured near the top and bottom, respectively, of rotatable upper portion 213, similar to the corresponding features of the first embodiment. Gondolas 218 are suspended from the ring 214 by support cables 220. As understood by those of ordinary skill in the art, as the diameter of ring 214 of the second embodiment 210 is increased relative that of ring 48 of the first embodiment 10, the dimensions, strength characteristics, etc. of the other features (e.g., vertical shaft 212, cables 216 and 217, and gondola support cables 220, and the like) should be correspondingly increased.

Furthermore, a plurality of fan means 222 (as opposed to the exemplary single fan means 72 of the first embodiment) may be desired or required to effectively rotate ring 214 of second embodiment 210 about its vertical shaft 212.

It is to be understood by those of ordinary skill in the art that the foregoing specification and drawings discussed with reference thereto are only exemplary embodiments of the present invention, with all such language being by way of example only. Individual features and aspects of the foregoing exemplary embodiments may be varied for accommodating alternative applications, all without departing from the spirit and scope of the present invention set forth in the appended claims.

What is claimed is:

1. An amusement ride, comprising:

a central, upright support mast;

support structure, rotatably mounted on the top of said upright support mast, and projecting axially outward from said mast, for free rotation thereabout generally in a plane perpendicular to the longitudinal axis of said mast;

passenger compartments suspended from said support structure generally near the periphery thereof;

at least one rotatably drivable propeller supported on said support structure, such that rotation of said propeller generates a flow of air creating a driving force acting generally tangentially at said support structure periphery, whereby said passenger compartments may be rotated about said central mast for forming a horizontal ferris wheel-type amusement ride having relatively smooth acceleration and deceleration characteristics; and a speed responsive safety means for automatically limiting the rotational speed of said amusement ride.

2. An amusement ride as in claim 1, wherein said support structure includes:

a generally central cylindrical member rotatably supported on top of said mast, with said mast being fixed;

a continuous rigid support ring, situated about and connected to said central member, and comprising sections which may be selectively disconnected from one another while remaining connected to said central member, for collapse and transport to said ride;

a plurality of cables interconnected said support ring and said central member for mutual rotation thereof about said support mast, with said passenger compartments suspended from the periphery of said support ring for rotation therewith; and a support beam, extending outwardly from said central member and fixed thereto for mutual rotation therewith, said support beam supporting said rotatably drivable propeller thereon.

3. An amusement ride as in claim 2, further including a second support beam, supporting thereon said speed responsive safety means for automatically limiting the rotational speed of said amusement ride.

4. A horizontal ferris wheel, comprising:

a relatively flat horizontal support surface and means for supporting a fixed vertical shaft thereon;

a vertical shaft supported on and extending upwardly from said support surface;

a hub assembly rotatably attached to the upper end of said vertical shaft;

an upper support portion of said ferris wheel situated generally about said hub assembly;

means for connecting said hub assembly to said upper support portion of said ferris wheel, with said upper support portion being rotatable about said vertical shaft on said hub assembly;

a plurality or passenger-carrying gondolas supported on said ferris wheel upper support portion;

a first support beam extending generally from said vertical shaft in a direction parallel to that of said ferris wheel upper support portion, said support beam having attached thereto a rotatable propeller; and means for rotating said propeller, whereby the force generated by a flow of air from the rotating propeller will cause the ferris wheel upper support portion and the gondolas supported thereon to rotate about said vertical shaft.

5. A horizontal ferris wheel as in claim 4, wherein:

said hub assembly includes an electrically-actuated solenoid brake thereon for selectively slowing rotation of said upper support portion; and said means for connecting include multiple first tensioned cables and multiple second tensioned cables attached generally between said upper support portion and said hub assembly, respectively, in a crisscrossing arrangement, thereby non-rotatably securing said upper support portion to said hub assembly at a fixed radius therefrom.

6. A horizontal ferris wheel as in claim 5, wherein said upper support portion includes a continuous rigid ring member comprised of multiple sections adapted to be disconnected from each other for at least partial collapse of said ferris wheel, and with said first and second tensioned cables remaining attached to said hub assembly and said multiple sections when so collapsed, whereby the ferris wheel can easily be collapsed, transported to a new desired location, and returned thereafter to an operable configuration.

7. A horizontal ferris wheel as in claim 4, wherein:

said support surface is defined on a towable trailer; and said gondolas are nestable, so as to be stacked on said trailer during transport of said ferris wheel.

8. A horizontal ferris wheel as in claim 4, further including:

a circular track proximate to the ground; and wherein said gondolas include a rolling or sliding surface on their underside which is adapted for contacting said circular track so as to guide said gondolas thereabout.

9. A horizontal ferris wheel as in claim 4, further including a second support beam extending generally from said vertical shaft, in a direction generally opposite that of said first support beam, said second beam supporting thereon a flyball governor means operatively connected to said rotatable propeller, and actuated by centrifugal forces for limiting air flow from said propeller whenever said horizontal ferris wheel reaches a given speed of rotation, thereby slowing such rotation.

10. A horizontal ferris wheel as in claim 4, wherein said means for rotating comprises an electric motor having a drive shaft with said propeller mounted thereon, and said ferris wheel further includes a reversible drum switch for controlling the direction of rotation and speed of said electric motor, so as to control rotation driving force to said ferris wheel.

11. A collapsible horizontal ferris wheel, comprising:

a movable platform defining a relatively flat horizontal upper support surface;

a fixed vertical shaft supported on, and extending upwardly from, said upper support surface, said shaft having a free upper end;

a hub assembly attached to said vertical shaft upper end, and including studs extending upwardly therefrom;

a cylindrical housing, having respective upper and lower ends, and rotatably mounted about said vertical shaft on said hub assembly, and further defining an inner bore having therein an insert plate adapted to matingly engage said studs;

rigid and continuous circular gondola support means, situated about said vertical shaft;

a plurality of first cables attached to said cylindrical housing upper end spaced about the circumference thereof, and extending respectively to said gondola support means;

a plurality of second cables attached to a said cylindrical housing lower end spaced about the circumference thereof, and respectively extending to said circular gondola support means, such that said first and second plurality of cables cooperate to suspend said circular support means on said vertical shaft at a generally predetermined elevation above said movable platform upper support surface;

a plurality of gondolas, suspended from said circular gondola support means and spaced thereabout, said gondolas being adapted for carrying passengers;

at least one support beam, having an outer end extending outwardly from said cylindrical housing in a direction generally parallel to said movable platform upper support surface;

fan means attached to said support beam outer end, said fan means including a rotatable propeller and a protective shroud generally thereabout; and power means for supplying power to said fan means propeller for rotation thereof, whereby the force generated by such fan means propeller rotation causes said cylindrical housing, said gondola support means, and said plurality of gondolas supported thereon, to rotate about said vertical shaft.

12. A collapsible ferris wheel as in claim 11, wherein said hub assembly includes an electrically-actuated solenoid brake for slowing said gondola rotation by frictionally engaging said cylindrical housing.

13. A collapsible horizontal ferris wheel as in claim 11, wherein said respective first and second plurality of cables attach to said circular support means in a criss-crossing pattern, thereby allowing said circular support means to be non-rotatably secured to said cylindrical housing at a constant radius therefrom.

14. A collapsible horizontal ferris wheel as in claim 11, wherein said circular gondola support means comprises a plurality of sections adapted to be disconnected from each other whenever said ferris wheel is collapsed, with said first and second plurality of cables remaining respectively attached to said cylindrical housing and their respective gondola support means sections, whereby the ferris wheel is adapted for at least partial collapse and transport thereof.

15. A collapsible horizontal ferris wheel as in claim 11, wherein said movable platform comprises a wheeled trailer for portability of said ferris wheel.

16. A collapsible horizontal ferris wheel as in claim 15, wherein said trailer includes a first retractable tongue for towing thereof, and further includes a second retractable tongue opposite said first retractable tongue, whereby a plurality of such trailers can be towed in a row with a single vehicle.

17. A collapsible horizontal ferris wheel as in claim 11, wherein said gondolas are stackable, so as to take up minimum space whenever the ferris wheel is readied for transport.

18. A collapsible horizontal ferris wheel as in claim 11, further including:

a circular track thereabout and proximate to the ground on which said movable platform is supported; and wherein the underside of said gondolas are adapted for contacting said circular track, which thereby guides the rotation path of such gondolas.

19. A collapsible horizontal ferris wheel as in claim 11, further including:

a second support beam extending from said cylindrical housing in a direction generally opposite that of said at least one support beam; and flyball governor means, supported on said second support beam and operatively connected to said fan means, said flyball governor means being actuated by centrifugal forces for limiting air flow force from said fan means whenever said horizontal ferris wheel reaches a predetermined speed of rotation, whereby the rotation of said horizontal ferris wheel is safely maintained.

20. A collapsible horizontal ferris wheel as in claim 11, wherein:

said power means comprises a reversible electric motor having a drive shaft with said propeller rotatably supported thereon; and said ferris wheel further includes a reversible switch means for controlling said electric motor for starting and stopping rotation of said ferris wheel gondolas.

21. A collapsible horizontal ferris wheel as in claim 11, wherein said ferris wheel is collapsed for portability thereof by disassembling said circular gondola support means into sections so as to relieve tension in said first and second plurality of cables, by folding said support beam downwardly towards said vertical shaft, and by stacking said gondolas on said movable platform support surface.

* * * * *